US006751906B2

(12) United States Patent
Bass

(10) Patent No.: US 6,751,906 B2
(45) Date of Patent: Jun. 22, 2004

(54) ADJUSTABLE TENSION GATE Z-BRACKET

(76) Inventor: Donnie E. Bass, 2033 Donnell Rd., Choctaw, OK (US) 73020

( * ) Notice: Subject to any disclaimer, the term of this patent is extended or adjusted under 35 U.S.C. 154(b) by 172 days.

(21) Appl. No.: 10/035,280

(22) Filed: Jan. 3, 2002

(65) Prior Publication Data

US 2002/0069587 A1 Jun. 13, 2002

Related U.S. Application Data

(60) Provisional application No. 60/254,757, filed on Dec. 12, 2000.

(51) Int. Cl.[7] ..... E05F 1/00; E04H 17/16

(52) U.S. Cl. ..... 049/387; 049/55; 256/73; 256/24

(58) Field of Search ..... 49/387, 386, 396, 49/49, 50–57; 256/24, 23, 30, 31, 73, 48, DIG. 2, 36, 35

(56) References Cited

U.S. PATENT DOCUMENTS

| | | | | | |
|---|---|---|---|---|---|
| 1,343,367 | A | * | 6/1920 | Jordan | 49/396 |
| 2,493,881 | A | * | 1/1950 | Ladd | 49/396 |
| 2,500,236 | A | * | 3/1950 | Anderson | 49/247 |
| 2,538,470 | A | * | 1/1951 | Peeples | 49/364 |
| 2,582,122 | A | * | 1/1952 | Haskett | 49/396 |
| 3,290,014 | A | * | 12/1966 | Stapleton | 256/73 |
| 4,088,294 | A | | 5/1978 | Aliment | |
| 4,468,888 | A | | 9/1984 | Harris | |
| 4,682,761 | A | | 7/1987 | Hanneken | |
| 4,779,379 | A | | 10/1988 | Steen | |
| 5,119,526 | A | | 6/1992 | Harsted | |
| 5,192,055 | A | | 3/1993 | Griggs | |
| 5,628,149 | A | * | 5/1997 | Kraczek | 49/396 |
| 5,716,041 | A | * | 2/1998 | Groves | 256/73 |
| 5,868,382 | A | * | 2/1999 | Groves | 256/73 |

* cited by examiner

*Primary Examiner*—Hugh B. Thompson, II
(74) *Attorney, Agent, or Firm*—Randal D. Homburg

(57) ABSTRACT

An adjustable tension gate bracket for application to fencing panels, specifically gate panel, applied to the frame components of the gate panel with diagonally adjustable interlocking and engaging upper and lower members for adjusting the swing and pitch of the gate panel, providing a stable support for the opening end of the gate.

4 Claims, 2 Drawing Sheets

ADJUSTABLE TENSION GATE Z-BRACKET

CROSS REFERENCE TO RELATED APPLICATIONS

Provisional Patent Application No. 60/254,757, filed on Dec. 12, 2000.

I. BACKGROUND OF INVENTION

1. Field of the Invention

The invention is an adjustable tension gate bracket for application to fencing panels, specifically gate panel, applied to the frame components of the gate panel with diagonally adjustable interlocking and engaging upper and lower members, adjusting the swing and pitch of the gate panel, and providing a stable support for the opening end of the gate.

2. Description of Prior Art

The following United States patents are identified and disclosed herein. Several devices are disclosed relating to gate braces and brackets. In U.S. Pat. No. 5,628,149 to Kraczek, a gate tensioning system is disclosed, a tensioning device located between the vertical and horizontal elements of the gate, including a removable panel on the cross brace is disclosed, the removable panel providing access to a turnbuckle within the cross-brace. A diagonal cross-brace assembly is disclosed for a fence post, the brace having pivotally attaching diagonal braces which are engaged with each other and adjustable using fasteners within a plurality of holes, providing adjustment of the brace to varying landscape and terrain. A diagonal stress and bracing system is disclosed in U.S. Pat. No. 4,682,761 to Hanneken, the brace securing fencing posts using a horizontal brace with a pair of diagonal anchor arms extending from the horizontal brace to the base of the posts. A chain tensioning system for a swinging gate is disclosed in U.S. Pat. No. 4,468,888 to Harris.

II. SUMMARY OF THE INVENTION

On most wooden or stockade fences, the gate panel is comprised of two or more horizontal supports upon which a plurality of vertical fencing slats are attached forming the fencing panel. The objective of the current invention is to provide an adjustable bracket for those gate panels used for in a wooden or stockade fence.

These gate panels are generally cut to fit the desired opening, hinges are attached between the horizontal supports on the gate panel and the fence post, and a gate catch is attached to the opening end of the gate to close the gate against another fence post. The present invention, having two horizontal members pivotally attaching to slidably engaging upper and lower diagonal tensioning rods, first attaches the two horizontal members of the invention to the horizontal supports on the gate panel. The slidably engaging upper and lower diagonal tensioning rods are then adjusted to obtain the proper swing, level and height of the opening end of the gate panel above the ground and to affix the gate latch on the gate panel at a constant height for proper engagement with the gate catch on the post to which the opening end of the gate panel is secured.

A second objective of the invention is to provide this adjustment not only at installation, but during the useful life of the fence and gate, readjusting to compensate for warping, sag, or damage to the fence, and insuring consistent level operation and swing of the gate panel.

III. DESCRIPTION OF THE DRAWINGS

The following drawings are informal drawings submitted with this provisional patent application.

IV. DESCRIPTION OF THE PREFERRED EMBODIMENT

Figure 1:
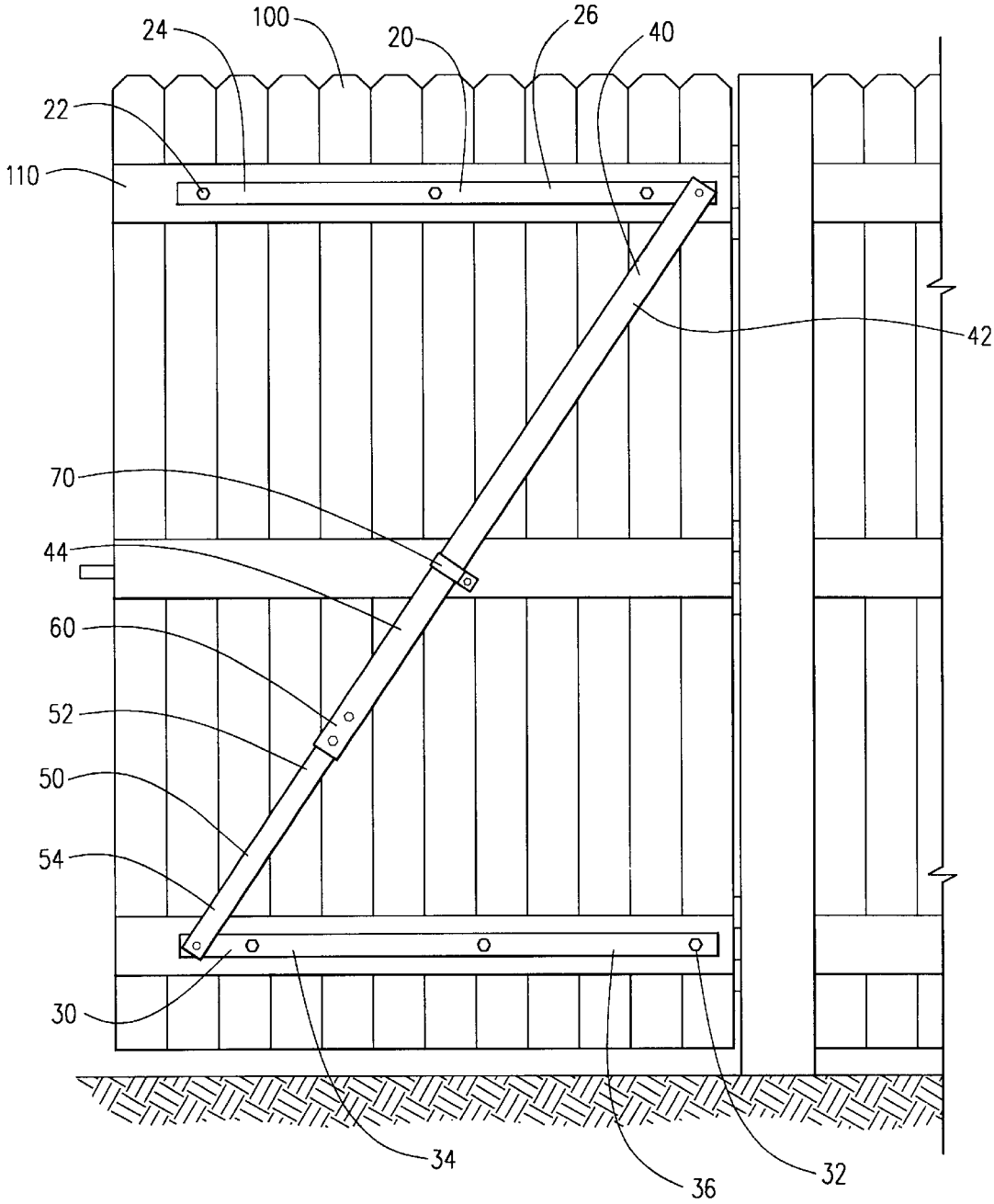
FIG. 1 is a front view of the invention installed on a fence gate panel.

The invention, as shown in FIGS. 1–4 of the drawings, is an adjustable tension gate bracket 10 for application to fencing panels, specifically swinging gate panels 100, applied to the horizontal frame components 110 of the swinging gate panel 100, the invention comprising an upper horizontal mounting member 20, a lower horizontal mounting member 30, an upper diagonal member 40, a lower diagonal member 50, a means 60 of adjustably connecting the upper diagonal member to the lower diagonal member, and a center diagonal anchor bracket 70.

The upper horizontal mounting member 20 has a plurality of holes 22 for mounting the upper horizontal mounting member 20 to the swinging gate panel 100 using screws 12, a first end 24 and a second end 26, the first end 24 positioned at the latch side of the swinging gate panel 100, the second end 26 positioned at the hinge side of the swinging gate panel 100. The lower horizontal mounting member 30 also has a plurality of holes 32 for mounting the lower horizontal mounting member 30 to the swinging gate panel 10 using screws 12, a first end 34 and a second end 34, the first end 34 positioned at the latch side of the swinging gate panel 100, the second end 36 positioned at the hinge side of the swinging gate panel 100.

Figure 2:
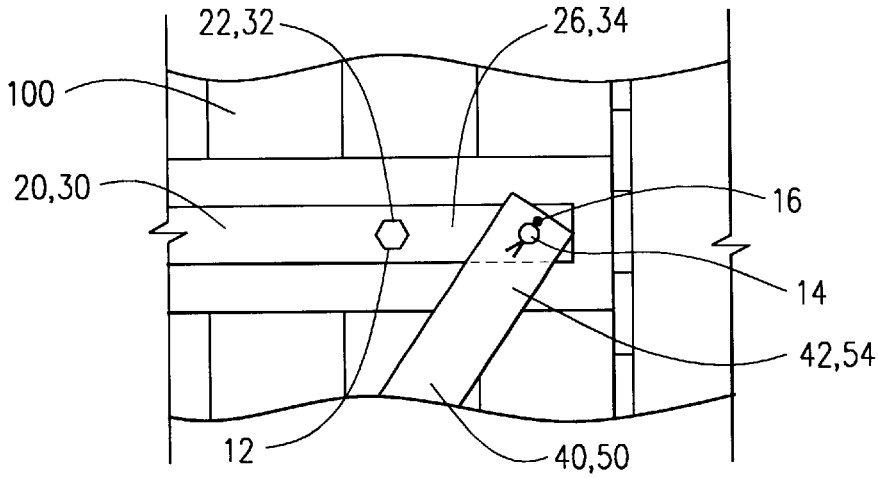
FIG. 2 is a view of the pivot joint between a horizontal member and a diagonal tensioning rod.

The upper diagonal member 40 has an upper end 42 and a lower end 44, the upper end 42 of the upper diagonal member 40 pivotally attached to the second end 26 of the upper horizontal mounting member 20, such pivotal attachment provided, in one embodiment as a smooth rivet 14 held onto the upper diagonal member 40 and the upper horizontal mounting member 20 by a cotter pin 16, as shown in FIG. 2 of the drawings. The lower diagonal member 50 has an upper end 52 and a lower end 54, the lower end 54 of the lower diagonal member 50 pivotally attached to the first end 34 of the lower horizontal mounting member 30, such pivotal attachment provided, in one embodiment as a smooth rivet 14 held onto the lower diagonal member 50 and the lower horizontal mounting member 30 by a cotter pin 16.

Figure 3:
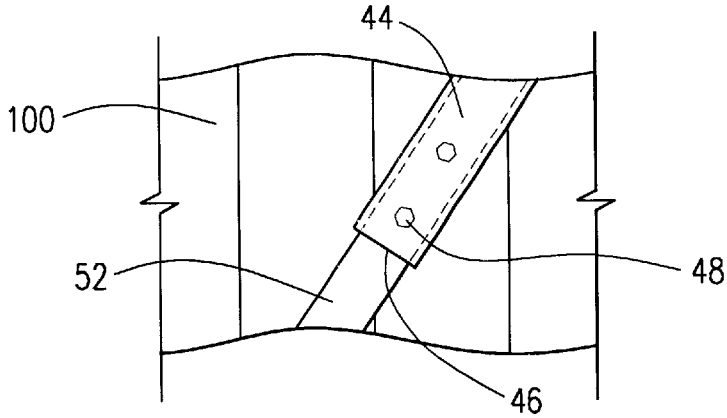
FIG. 3 is a view of an embodiment of the slidable engagement joint of the upper and lower tensioning rods.
Figure 4:
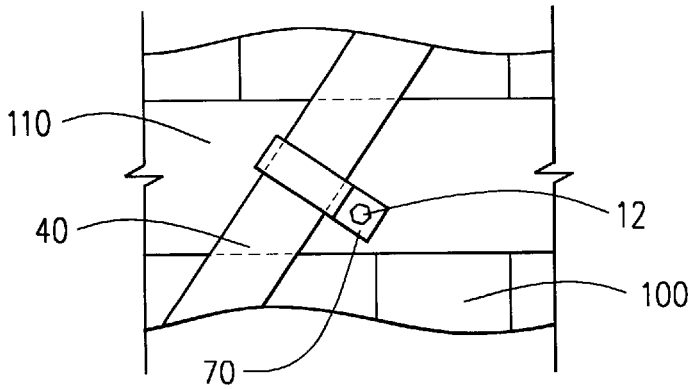
FIG. 4 is a view of the center diagonal anchor bracket.

The lower end 44 of the upper diagonal member and the upper end 52 of the lower diagonal member are provided with the means 60 of adjustably connecting the upper diagonal member to the lower diagonal member. In a preferred embodiment, as shown in FIG. 3 of the drawings, such means 60 of adjustably connecting the upper diagonal member to the lower diagonal member is provided for by the lower end 44 of the upper diagonal member forming an enlarged cavity 46 suited to receive the upper end 52 of the lower diagonal member, the enlarged cavity 46 having at least one Allen screw 48 which captures the upper end 52 of the lower diagonal member 50 received within such enlarged cavity 46 in a fixed manner. The center diagonal anchor bracket 70 attaches the upper diagonal member 40 to the swinging gate panel 100, as shown in FIG. 4 of the drawings, providing additional stability to the invention 10 and the swinging gate panel 100.

The invention is preferably applied to the swinging gate panel 100 after such swinging gate panel 100 is mounted onto the fence post and any other hardware is applied. The upper horizontal mounting member 20, the upper diagonal member 40, the lower diagonal member 50 and the lower horizontal mounting member 30 are assembled together, after which the upper and lower horizontal mounting members 20,30 are attached to the horizontal frame supports 110 of the swinging gate panel 100, preferably using screws 12 applied through the plurality of holes 22,32. The means 60 of adjustably connecting the upper diagonal member to the lower diagonal member is then adjusted as the swinging gate panel 100 is opened and closed to determine the appropriate swing and pitch of the swinging gate panel 100, adjusting the hinge side of the swinging gate panel, up or down as needed until the proper height of the latch side is obtained. The means 60 of adjustably connecting the upper diagonal member to the lower diagonal member is then fixed to maintain such swing and pitch of the swinging gate panel 100. If the swinging gate panel 100 needs later adjustment, the means 60 of adjustably connecting the upper diagonal member to the lower diagonal member may be loosened and then tightened after readjustment is made.

Although the embodiments of the invention have been described and shown above, it will be appreciated by those skilled in the art that numerous modifications may be made therein without departing from the scope of the invention as herein described.

I claim:

1. An adjustable tension gate bracket for application to fencing panels, specifically swinging gate panels, for use with horizontal frame components of said swinging gate panel, the bracket essentially comprising:

an upper horizontal mounting member adapted to be attached to one of said horizontal frame components;

a lower horizontal mounting member adapted to be attached to another of said horizontal frame components;

an upper diagonal member pivotally attached to said upper horizontal member;

a lower diagonal member pivotally attached to said lower horizontal member;

a means of adjustably connecting said upper diagonal member to the said lower diagonal member; and a center diagonal anchor bracket adapted to attach said upper diagonal member to said swinging gate panel.

2. An adjustable tension gate bracket for application to fencing panels, specifically swinging gate panels, for use with horizontal frame components of said swinging gate panel, the bracket comprising:

an upper horizontal mounting member having a plurality of holes for mounting said upper horizontal mounting member to said swinging gate panel using screws, and a first end and a second end, said first end positionable at a latch side of said swinging gate panel, said second end positionable at a hinge side of said swinging gate panel;

a lower horizontal mounting member having a plurality of holes for mounting said lower horizontal mounting member to said swinging gate panel using screws, and a first end and a second end, said first end positionable at said latch side of said swinging gate panel, said second end positionable at said hinge side of the said swinging gate panel;

an upper diagonal member having an upper end and a lower end, said upper end of the said upper diagonal member held together by a pivotal attachment to said second end of said upper horizontal mounting member, a lower diagonal member having an upper end and a lower end the said lower end of the said lower diagonal member held together by a pivotal attachment to said first end of said lower horizontal mounting member;

a means of adjustably connecting said upper diagonal member to said lower diagonal member; and a center diagonal anchor bracket.

3. The bracket, as disclosed in claim 2, wherein said pivotal attachments define a smooth rivet fixing said upper diagonal member and said upper horizontal mounting member by a cotter pin and a smooth rivet fixing said lower diagonal member and said lower horizontal mounting member by a cotter pin.

4. The bracket, as disclosed in claim 2, wherein said means of adjustably connecting said upper diagonal member to said lower diagonal member is provided for by said lower end of said upper diagonal member forming an enlarged cavity suited to receive said upper end of said lower diagonal member, said enlarged cavity having at least one Allen screw which captures said upper end of said lower diagonal member received within said enlarged cavity in a fixed manner, and said center diagonal anchor bracket adapted to attach upper diagonal member to said swinging gate panel, providing additional stability between said bracket and said swinging gate panel.

* * * * *